US009505013B2

(12) United States Patent
Arnett

(10) Patent No.: US 9,505,013 B2
(45) Date of Patent: Nov. 29, 2016

(54) CONTAINER CLEANER

(75) Inventor: Michael Arnett, Olmsted Township, OH (US)

(73) Assignee: VITA-MIX MANAGEMENT CORPORATION, Olmsted Township, OH (US)

( * ) Notice: Subject to any disclaimer, the term of this patent is extended or adjusted under 35 U.S.C. 154(b) by 934 days.

(21) Appl. No.: 13/475,414

(22) Filed: May 18, 2012

(65) Prior Publication Data

US 2012/0291826 A1 Nov. 22, 2012

Related U.S. Application Data

(60) Provisional application No. 61/488,352, filed on May 20, 2011.

(51) Int. Cl.

| | |
|---|---|
| ***A47L 17/00*** | (2006.01) |
| ***B05B 1/30*** | (2006.01) |
| ***A47L 17/02*** | (2006.01) |
| ***E03C 1/02*** | (2006.01) |
| ***B05B 1/14*** | (2006.01) |
| ***B05B 13/06*** | (2006.01) |

(52) U.S. Cl.

CPC ..... *B05B 1/3013* (2013.01); *A47L 17/00* (2013.01); *A47L 17/02* (2013.01); *B05B 1/14* (2013.01); *B05B 13/069* (2013.01); *E03C 1/02* (2013.01)

(58) Field of Classification Search

None

See application file for complete search history.

(56) References Cited

U.S. PATENT DOCUMENTS

| | | | | |
|---|---|---|---|---|
| 1,940,615 | A * | 12/1933 | Webster | B08B 9/34 134/167 R |
| 2,028,690 | A | 1/1936 | Schamer et al. | |
| 2,228,984 | A * | 1/1941 | Broecker | F16K 15/20 137/231 |
| 2,396,449 | A * | 3/1946 | Wahlin | B05B 1/14 239/460 |
| 3,279,495 | A * | 10/1966 | Taylor | E03B 9/20 137/454.6 |
| 3,561,648 | A * | 2/1971 | Humphrey | F16K 11/022 222/207 |
| 4,717,073 | A | 1/1988 | Bielka | |
| 4,860,788 | A * | 8/1989 | Asaoka | F15B 13/015 137/491 |
| 4,934,402 | A * | 6/1990 | Tarnay | F16K 11/04 137/119.04 |
| 5,419,348 | A * | 5/1995 | Kuta | B08B 9/32 134/144 |
| 5,901,906 | A | 5/1999 | Bouldin | |
| 5,957,333 | A | 9/1999 | Losenno et al. | |
| 7,341,209 | B1 | 3/2008 | Ko | |
| 8,555,922 | B2 | 10/2013 | Migliore et al. | |
| 2005/0145717 | A1* | 7/2005 | Katz | A47L 15/0065 239/279 |
| 2009/0095322 | A1 | 4/2009 | Wakao et al. | |
| 2010/0212076 | A1 | 8/2010 | Kihs | |
| 2010/0229894 | A1 | 9/2010 | Nagatani et al. | |

OTHER PUBLICATIONS

Young, Lee W., International Search Report, Aug. 1, 2012 regarding PCT/US12/38591.

Young, Lee W., Written Opinion of the International Searching Authority, Aug. 1, 2012 regarding PCT/US12/38591.

Trimarchchi, Roberto, Supplementary European Search Report, Oct. 6, 2014, Munich Germany.

(Continued)

*Primary Examiner* — Michael Barr

*Assistant Examiner* — Cristi Tate-Sims

(74) *Attorney, Agent, or Firm* — McDonald Hopkins LLC

(57) ABSTRACT

A container cleaner includes a body having a fluid inlet, a fluid passage within the body, and a nozzle assembly. The nozzle assembly comprises a spray head, a plunger movable relative to a spray head, and a stopper having an opening to receive a portion of the plunger. The spray head may include a plurality of spray apertures formed in the spray head. The spray apertures are angled to direct fluid to portions of a container placed over the container cleaner.

20 Claims, 7 Drawing Sheets

(56) References Cited

OTHER PUBLICATIONS

Trimarchi, Roberto, Supplementary European Search Report, PCT/US2012/038591, Oct. 6, 2014, European Patent Office, Munich, Germany.

Copenheaver, Blaine R., International Search Report and Written Opinion, PCT/US2013/070346, Apr. 14, 2014, International Searching Authority/US.

Young, Lee W., International Search Report and Written Opinion, PCT/US2012/038591, Aug. 1, 2012, International Searching Authority/US.

* cited by examiner

CONTAINER CLEANER

CROSS-REFERENCE TO RELATED APPLICATION

This application claims priority to Provisional Patent Application No. 61/488,352 entitled "CONTAINER CLEANER," filed on May 20, 2011, which is hereby incorporated by reference in its entirety.

TECHNICAL FIELD

The present invention relates to a device for cleaning a container, and more particularly, to a device that can emit a high pressure spray to clean the interior of a liquid food container such as a pitcher, blender container and the like.

BACKGROUND

Many liquid food containers, such as pitchers, blender containers and the like, are difficult to clean, primarily because of their depth. These types of containers are often in need of frequent cleaning, for example, in commercial environments, such as a restaurant or cocktail lounge, where the blender container may be continually used to blend different drinks.

One possible way to clean these deep containers is to provide a nozzle-like device connected to a water or fluid inlet. Such devices, however, require the close attention of the user who must hold the container with one hand and the nozzle with the other while directing the spray to various locations in the container.

In an alternative design, a low profile platform may be used with an upwardly directed nozzle that is in fluid communication with a water source. A container to be cleaned is inverted, and when its rim engages the platform, a spray is emitted from the nozzle. However, such a device does not assure the complete cleaning of the entire container, particularly for containers that have a greater depth. Moreover, the low profile unit is particularly ineffective for cleaning the bottom of a container, and when the container bottom includes blades, as would be found in a container of a blender, the bottom of the blades are particularly difficult to clean.

As a result, a device has been developed wherein the nozzle is positioned on top of a vertically oriented tower which extends upwardly from a base. The tower can be placed in communication with water under pressure. When the bottom of an inverted container is pressed against the top of the tower, a spray is emitted at that location.

Several problems exist with current designs of this type of device. One such problem is that the spray angle of the nozzle may fail to direct water to all interior portions of the container, thus preventing efficient clean the container. In addition, a great amount of pressure is required to actuate the nozzle. Further, current designs require multiple seals, which increases the total sealing area and provides more opportunities for leaking.

Thus, the need exists for an improved container cleaning device.

SUMMARY

A container cleaner is generally provided. The container cleaner includes a body having a fluid inlet and a tube within the body to pass fluid from the fluid inlet to a nozzle assembly. The nozzle assembly comprises a spray head, a plunger capable of being depressed relative to a spray head, and a stopper having an opening therein to receive a portion of the plunger. The stopper may be arranged to seal the connection between the spray head and the body.

In an embodiment, a stem is connected to the plunger and includes a base to form a seal with the stopper between the tube and the nozzle assembly. Depressing the plunger breaks the seal between the base and the stopper and allows fluid to flow from the tube to the spray head.

The spray head may include a plurality of spray apertures formed in the spray head. The spray apertures are angled to direct fluid to portions of a container placed over the container cleaner. The spray apertures may be arranged at an angle between 90 degrees and 180 degrees with respect to a side wall of the container cleaner, such as 160 degrees.

DESCRIPTION OF THE DRAWINGS

Objects and advantages together with the operation of the invention may be better understood by reference to the following detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A container cleaning device 10 is generally provided. The components of the container cleaning device 10 may be made of any appropriate material, such as molded of a suitable plastic material such as acrylonitrile butadiene styrene (ABS) or similar material.

The container cleaning device 10 includes a base 12. The base 12 may be any appropriate size and shape, such as generally cylindrical. The base 12 may include an inlet 14 to receive a fluid into the base 12. The inlet 14 may be adapted to engage a fluid transferring device, such as a pipe or a hose.

Figure 1:
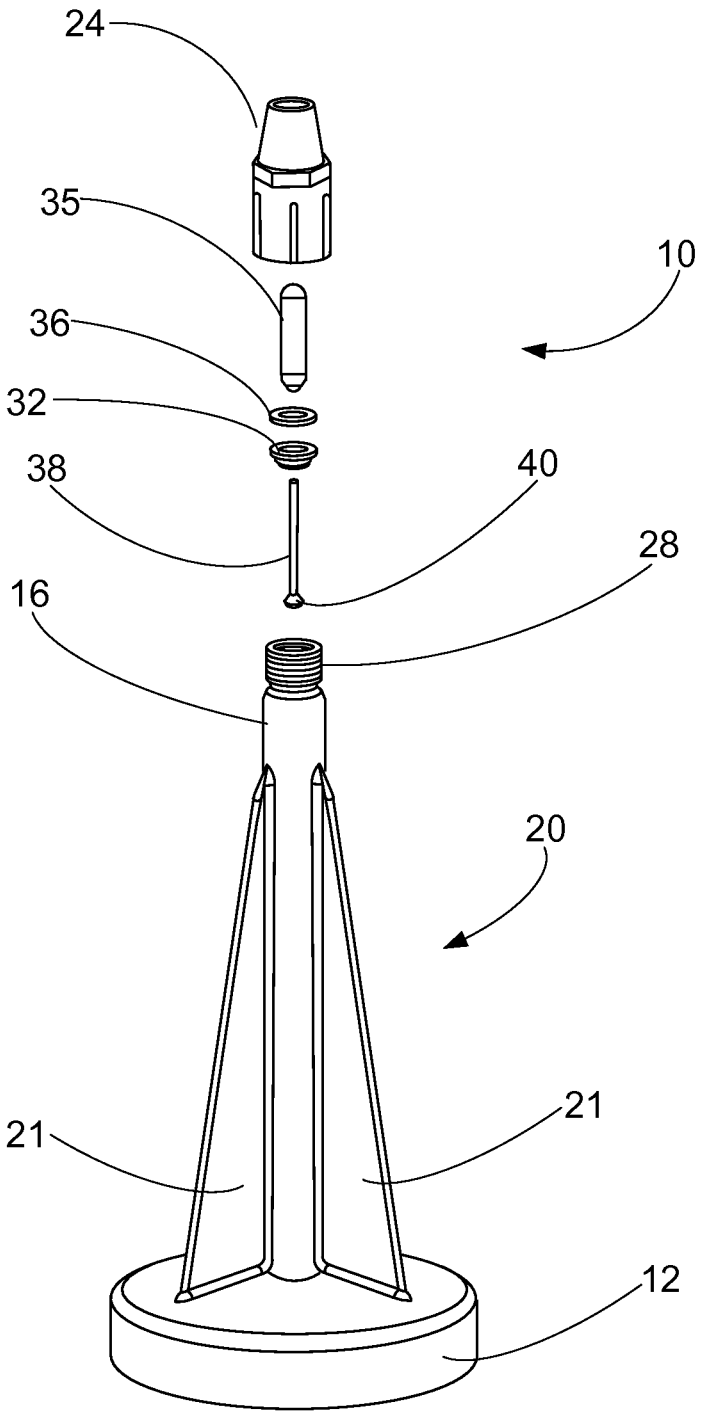
FIG. 1 is an exploded view of a container cleaner.
Figure 2:
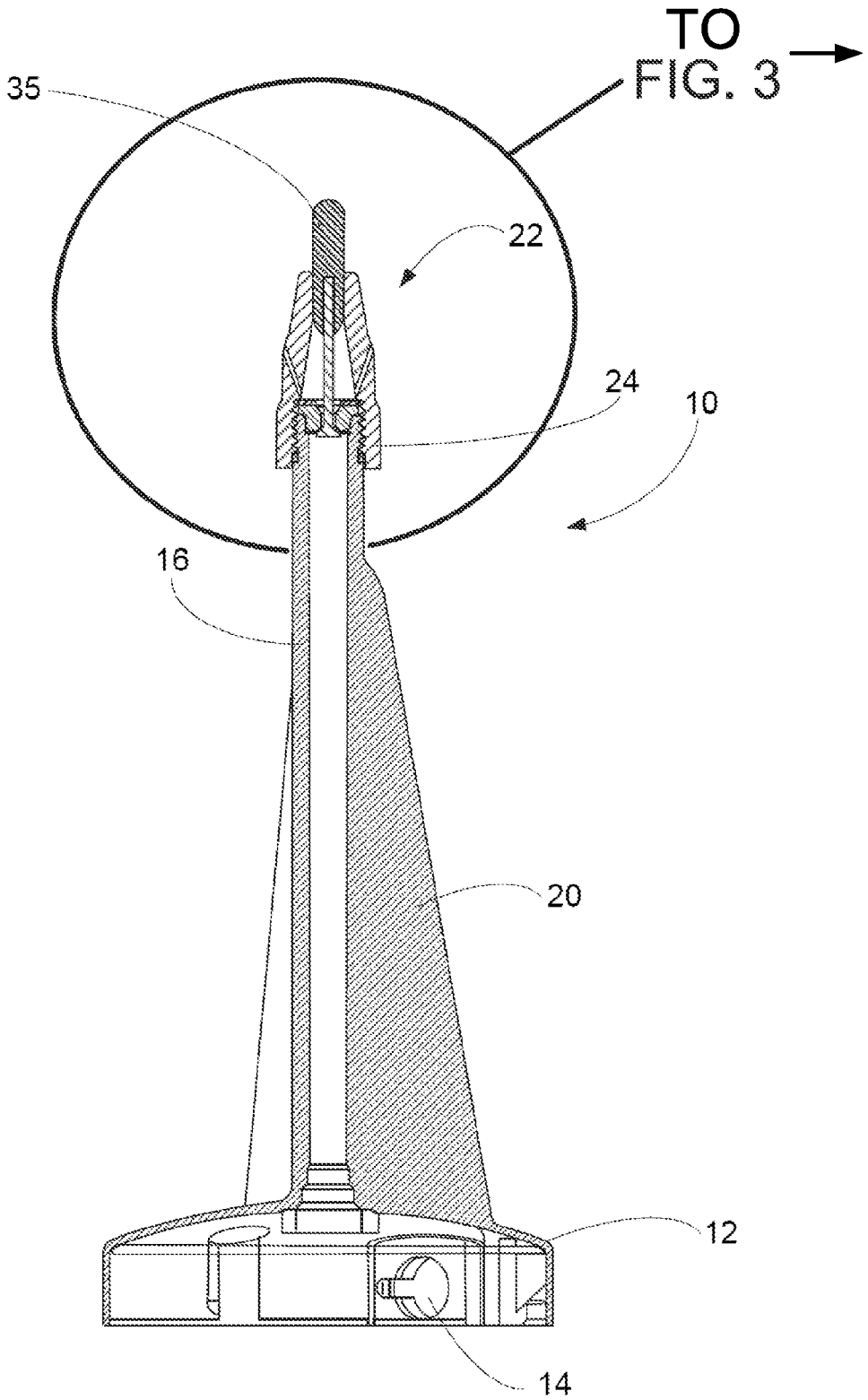
FIG. 2 is a cross-sectional view of a container cleaner.

The container cleaner 10 may include a tube 16. The tube 16 may be any appropriate length and shape, such as generally cylindrical. The tube 16 may be connected to the base 12, such as integrally formed with the base 12 or otherwise connected thereto. The tube 16 may be arranged at any appropriate orientation, such as substantially vertical or perpendicular to the base 12 or structure supporting the base 12, as illustrated in FIGS. 1 and 2.

The tube 16 may be in fluid communication with the inlet 14. The base 12 may include tubes, pipes and other appropriate links and connectors between the inlet 14 and the tube 16 to assist in the passage of fluid between the inlet 14 and the tube 16.

The container cleaner 10 may include an outer surface 20. The outer surface 20 may surround the tube 16 to provide support for the tube 16. The surface 20 may be tapered and arranged with its largest portion near the base 12. The surface 20 may further comprise a plurality of tapered fins 21 to provide structural support for the tube 16.

A nozzle assembly 22 may be positioned near the upper portion of the container cleaner 10. The nozzle assembly 22 may be generally configured to receive fluid from the tube 16 and direct a pressurized spray to portions of a container to be cleaned.

Figure 3:
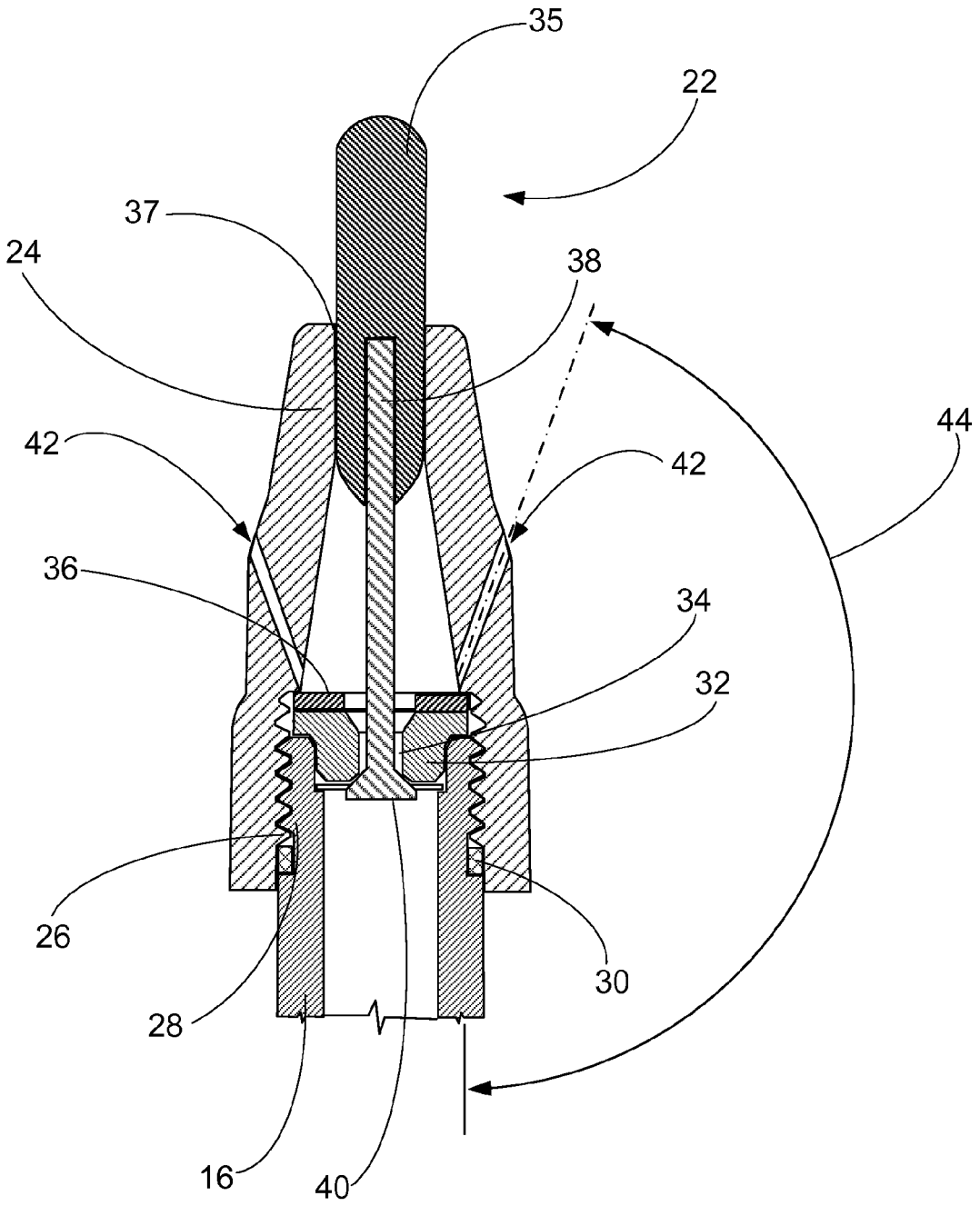
FIG. 3 is a cross-sectional view of a nozzle assembly.
Figure 4:
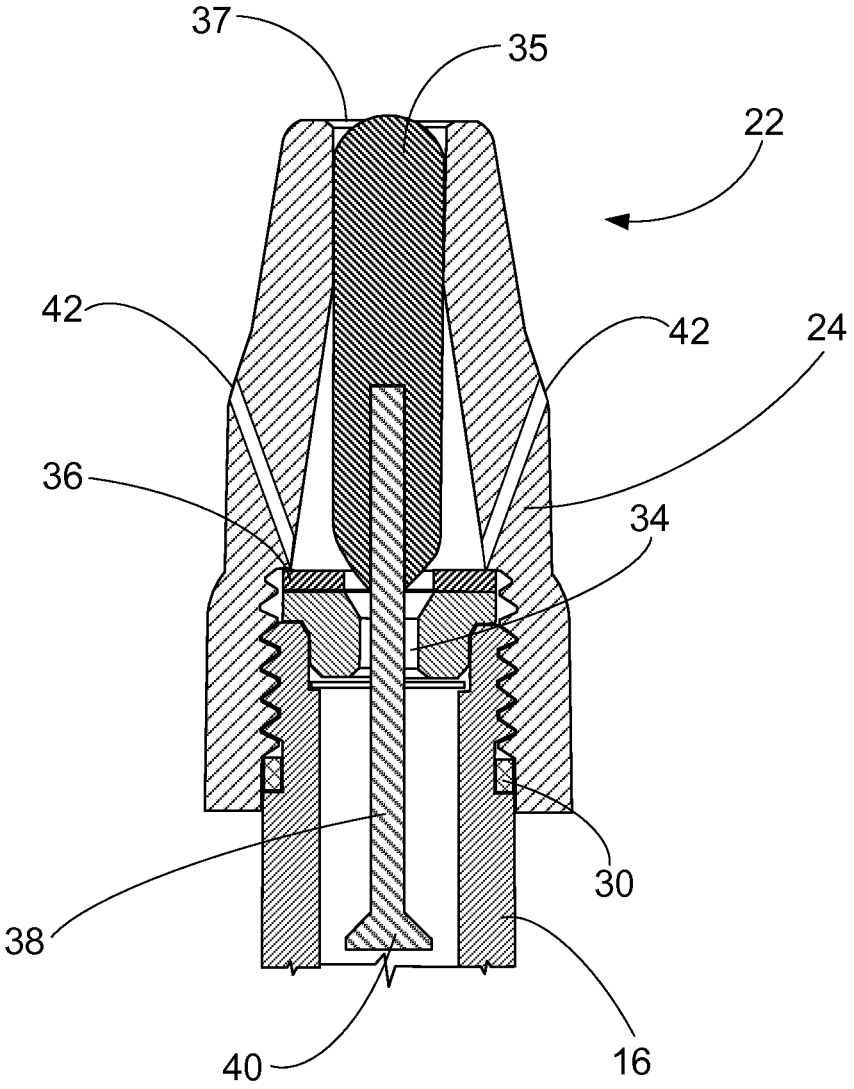
FIG. 4 is a cross-sectional view of a nozzle assemble with the plunger depressed.

The nozzle assembly 22 may comprise a spray head 24 about its outer surface. The spray head 24 may be shaped similar to an inverted cup and have a generally open interior, as illustrated in FIGS. 3 and 4. The spray head 24 may connect to a portion of the container cleaner 10, such as directly to the tube 16. For example, the spray head 24 may include a threaded portion 26 about its interior configured to engage a similarly threaded portion 28 at the exterior of the tube 16. It will be appreciated, however, that the nozzle assembly 22 may be welded, molded or otherwise connected to the tube 16 by any means known in the art.

A slot 30 may be formed in the outer wall of tube 16 adjacent to the threaded portion 28. The slot 30 may be any appropriate size and shape and configured to receive an o-ring (not shown) therein. The o-ring may provide a fluid seal between tube 16 and nozzle assembly 22.

A stopper 32 is disposed within spray head 24 near the top of the tube 16. The stopper 32 may be any appropriate size and shape, such as generally cylindrical, and may be composed of any appropriate material, such as rubber. In an embodiment, the stopper 32 may have an L-shaped cross-section. A lower portion of the L-shaped stopper 32 may expand within the upper end of the tube 16. The wider, upper portion of the L-shaped stopper 32 may overlap the top edge of the tube 16 and expand within the inner circumference of the spray head 24. The L-shaped seal therefore seals both the internal circumferences of the tube 16 and spray head 24 as well as the boundary between the tube 16 and spray head 24.

The stopper 32 may include an opening 34. The opening 34 may be any appropriate size and shape and may be located at any appropriate position, such as substantially centered along a central axis of the tube 16. The opening 34 may allow fluid from the tube 16 to pass to the nozzle assembly 22. A washer 36 may be positioned above the stopper 32. The opening of the washer 36 may be generally aligned with the seal opening 34.

The nozzle assembly 22 may include a plunger 35. The plunger 35 may be any appropriate size and shape, such as generally cylindrical, and may be composed of any appropriate material, such as plastic or rubber. A portion of the plunger 35 may protrude through an upper opening 37 in the top of the nozzle assembly 22 to expose the plunger 35 above the spray head 24. The plunger 35 may form a seal with the opening 37 to prevent pressurized fluid from exiting via the opening 37. The plunger 35 may be movable within the opening 37, as further described below.

A stem 38 may extend downwardly from a bottom portion of the plunger 35. The stem 38 may be any appropriate size and length. The stem 38 may be integrally formed with the plunger 35 or otherwise connected thereto. The stem 38 may extend through the opening in the washer 36 and the opening 34 in the stopper 32. The stem 38 may have an enlarged base 40 at its distal end. The base 40 may be any appropriate size and shape, such as generally circular. The base 40 may be wider in diameter than the opening 34 to allow the base 40 to completely cover the opening 34 and provide a fluid seal between the tube 16 and the spray head 24. The stem 38 may be tapered toward the enlarged base 40. The tapered shape of the stem 38 may further assist in forming a seal between the base 40 and the opening 34.

In an embodiment, the area of the opening 34 may be less than 0.5 square inches, such as approximately 0.2 square inches. The area of the base 40 may therefore be greater than 0.2 square inches to completely cover the opening 34.

The spray head 24 may include one or more spray apertures 42. For example, the spray head may include four spray apertures 42. The spray apertures 42 may comprise generally tubular openings in the spray head 24. The spray apertures 42 openings may be any appropriate size and shape, such as generally circular.

In an embodiment, the spray apertures 42 may be configured to direct fluid at a desired angle. As illustrated in FIG. 2, the spray aperture 42 may be arranged at an angle 44 with respect to tube 16. The angle 44 may be approximately 160 degrees from the outer wall of the tube 16. It will be appreciated, however, that the spray apertures 42 may be arranged at any appropriate angle 44, such as any angle 44 between 90 degrees and 180 degrees from the outer wall of the tube 16.

In use, pressurized fluid may be fed into the base 12 and through the tube 16. The pressurized fluid near the top of the tube 16 may engage the base 40 of the stem 38 and force the base 40 against the stopper 32 to seal the opening 34. The seal formed at the opening 34 prevents fluid from moving through the tube 16 into the nozzle assembly 22.

The pressurized fluid may provide sufficient force to form a seal between the base 40 and the opening 34. Reducing the area of the base 40 lowers the hydrostatic force required to form a seal at the stopper 32. By reducing the area of the opening 34 to less that 0.5 square inches, the area of the base 40 can also be reduced, thus lowering the required sealing force. As a result, additional components such as springs and other biasing members are not needed to create a seal between the base 40 and the opening 34.

The plunger 35 may be depressed relative to the spray head 24 to allow fluid to pass from the tube 16 into the nozzle assembly 22. For example, a container may be inverted and placed over the container cleaner 10 such that a bottom portion of the container is pressed against the plunger 35. As the plunger 35 is depressed, the base 40 is moved away from the opening 34 to allow pressurized fluid to flow from the tube 16 into the spray head 24. Pressurized fluid may then exit from the spray head 24 via the spray apertures 42 and into the container.

Figure 5:
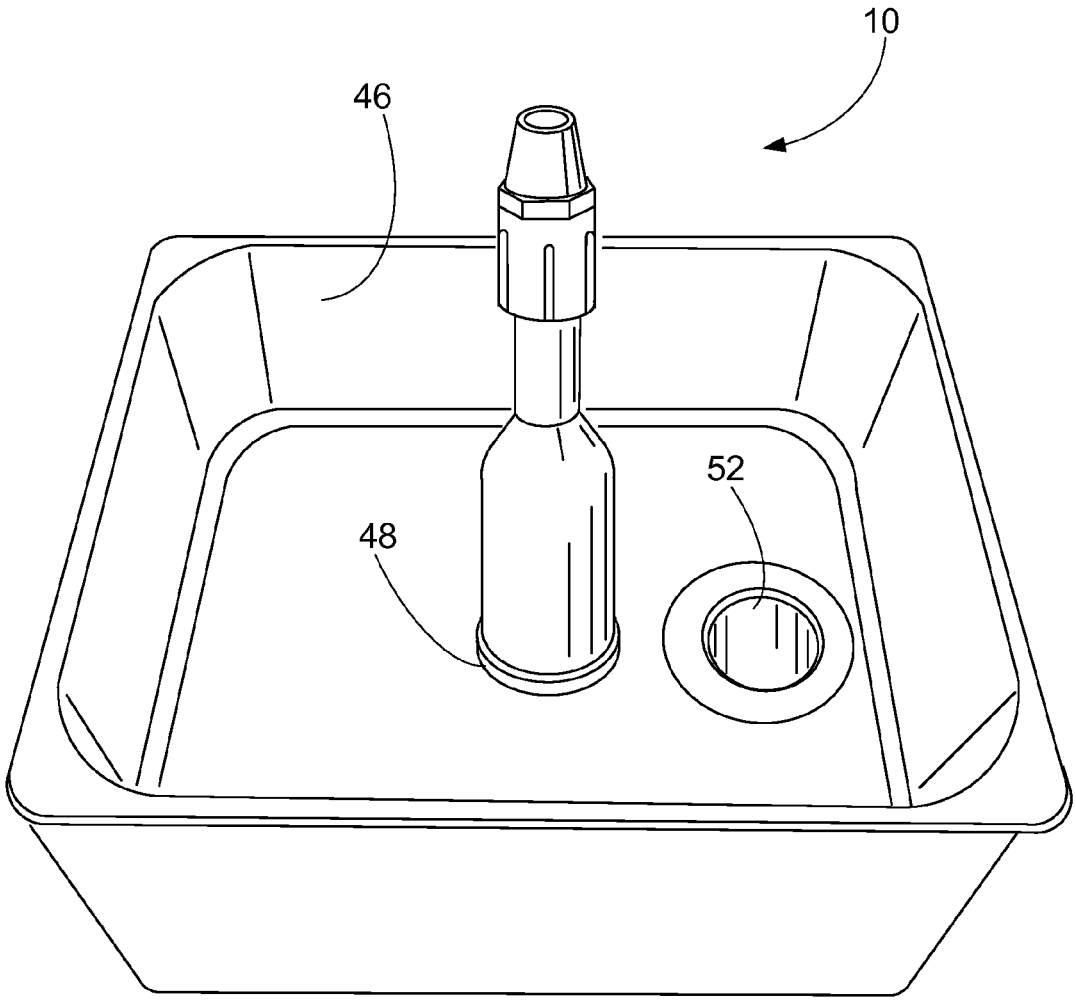
FIG. 5 is a perspective view of a container cleaner with a sink.
Figure 6:
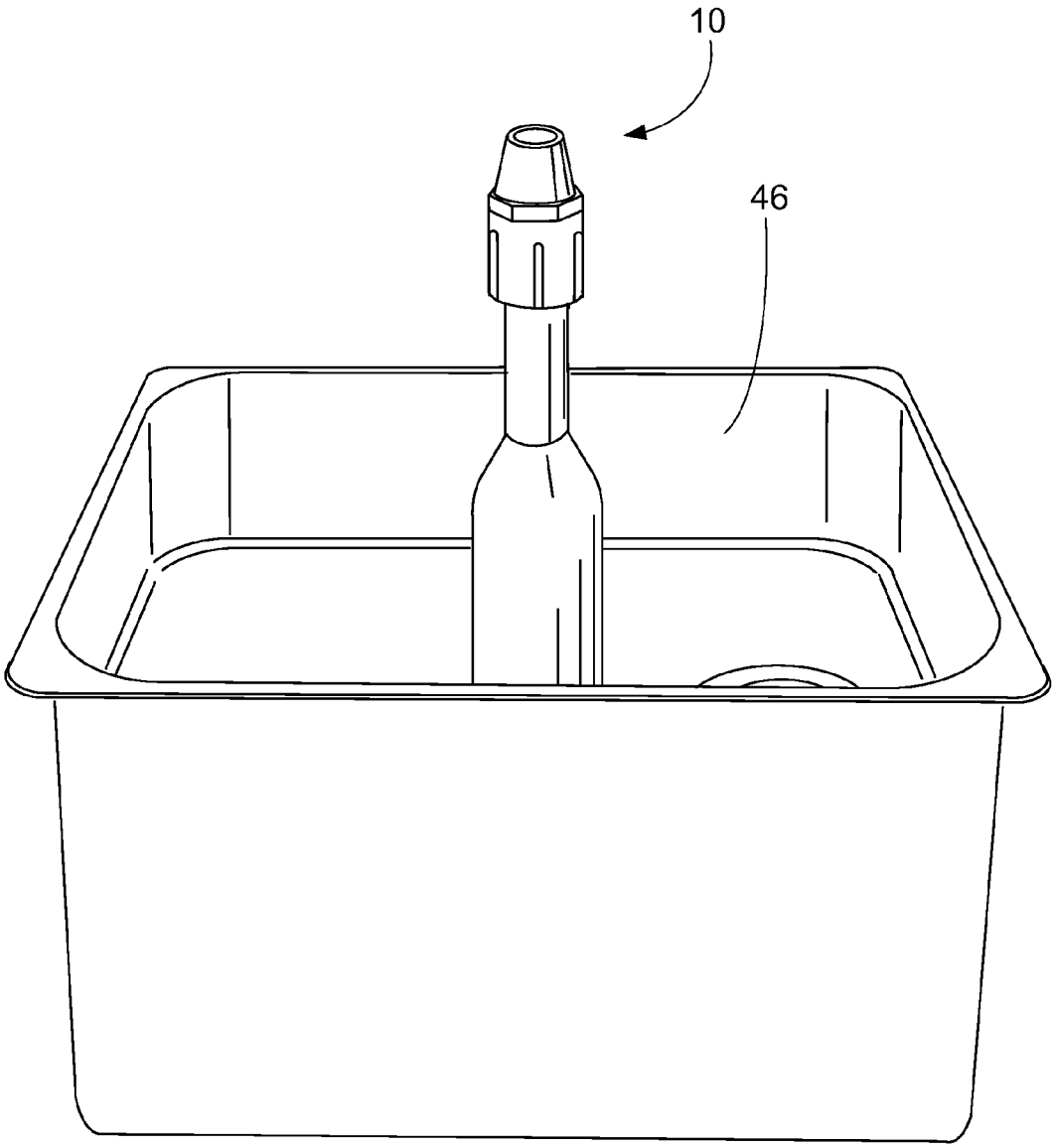
FIG. 6 is a side view of a container cleaner with a sink.
Figure 7:
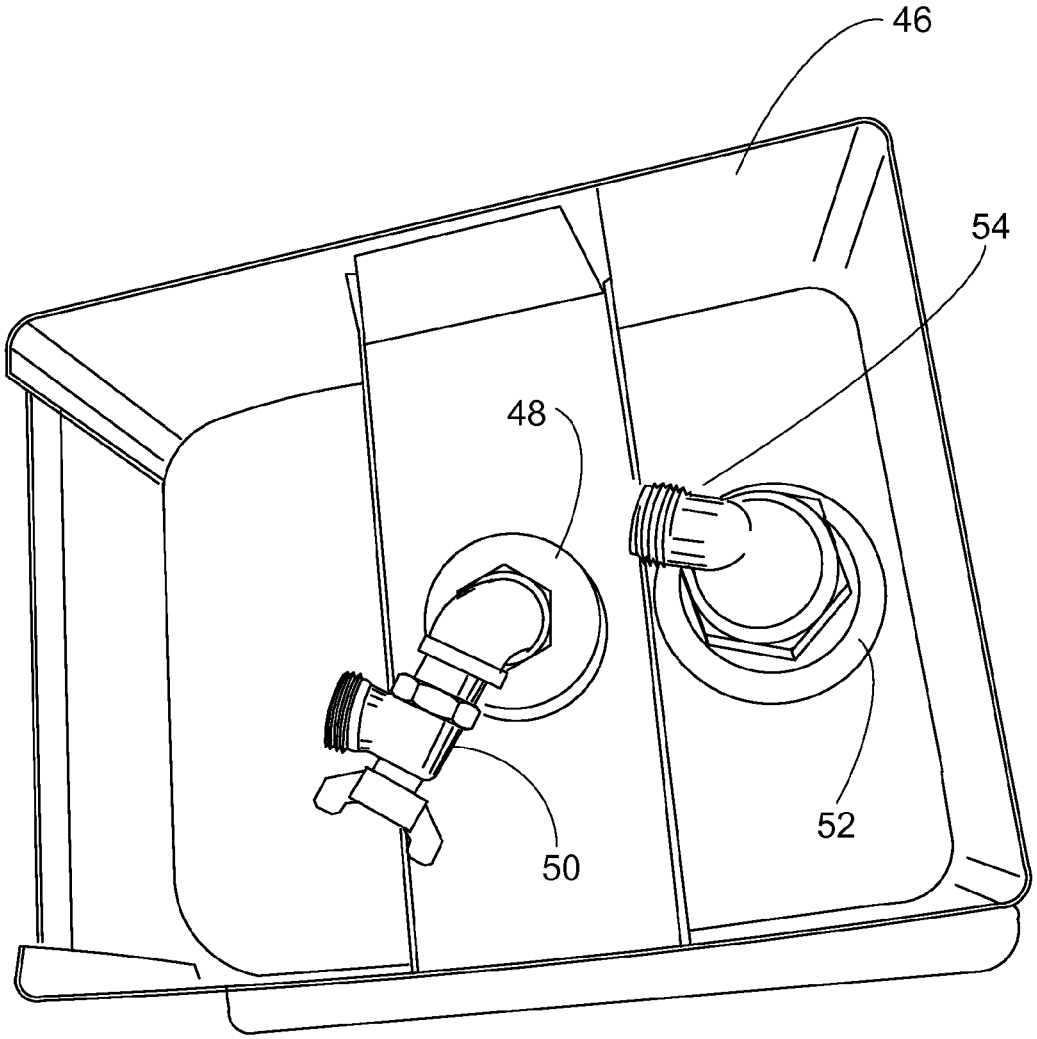
FIG. 7 is a bottom view of a container cleaner with a sink.

The container cleaner 10 may be mounted within a sink 46, as shown in FIGS. 5-7. The sink 46 may be any appropriate size and shape, such as forming a generally square basin.

The sink 46 may include two or more openings. A first opening may be configured to be an inlet 48. The inlet may include an inlet pipe 50 to receive fluid, such as water. A second opening may be a drain 52. The drain 52 may include a drain pipe 54 to divert drain water to the appropriate path. The base 12 may be mounted at or above the inlet 48 and receive fluid from the inlet 48. The sink 46 may capture excess and drain fluid that is exited from the container cleaner to direct the fluid to the appropriate drain.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

What is claimed is:

1. A container cleaner comprising:

a body having a fluid inlet;

a fluid passage in communication with the fluid inlet and extending within the body; and a nozzle assembly comprising:

a spray head having a first opening connected to the body and in fluid communication with the fluid passage, and a second opening;

a plunger protruding through the second opening and moveable between a first position and a second position;

a stem extending from the plunger, the stem comprising a base portion; and a stopper having an opening therein and configured to receive the at least a portion of the stem therethrough, wherein the base portion is configured to receive fluid pressure from within the fluid inlet, and in response to receiving the fluid pressure, form a seal with the stopper between the spray head and the body without using a biasing member; and wherein the plunger operatively moves to the second position in response to receiving mechanical pressure that is greater than the fluid pressure received by the base portion.

2. The container cleaner of claim 1, wherein the body comprises a base.

3. The container cleaner of claim 1, wherein the nozzle assembly includes a threaded portion engaged with a threaded portion of the body.

4. The container cleaner of claim 1 further comprising an o-ring positioned between the spray head and the body.

5. The container cleaner of claim 1, wherein the area of the stopper opening is less than 0.5 square inches.

6. The container cleaner of claim 5, wherein the area of the stopper opening is 0.2 square inches.

7. The container cleaner of claim 1 further comprising one or more fins protruding from an exterior surface of the body.

8. A container cleaner comprising:

a body having an exterior wall and including a fluid inlet;

a fluid passage in communication with the fluid inlet and extending within the body; and a nozzle assembly comprising:

a spray head connected to the body and in fluid communication with the fluid passage, the spray head including an opening;

a plunger protruding through the opening at a distal end of the spray head and moveable between a first position and a second position;

a base portion protruding from the plunger;

a stopper having an opening therein and configured to receive a portion of the plunger; and at least one aperture in the spray head, wherein the aperture is arranged at an angle between 90 degrees and 180 degrees with respect to the exterior wall of the body, wherein the fluid inlet operatively receives a pressurized fluid and wherein the base portion receives pressure from the fluid to bias the plunger in the first position without using a spring; and wherein the plunger operatively moves to the second position in response to receiving mechanical pressure that is greater than the pressure of the pressurized fluid received by the base portion.

9. The container cleaner of claim 8, wherein the at least one aperture is arranged at an angle of 160 degrees with respect to the exterior wall of the body.

10. The container cleaner of claim 8, wherein the stopper is positioned to seal the connection between the spray head and the body.

11. The container cleaner of claim 8, wherein the stopper has an L-shaped cross-sectional shape.

12. The container cleaner of claim 8, wherein the container cleaner includes four apertures in the spray head.

13. The container cleaner of claim 8, wherein the plunger is capable of forming a seal with the opening in the spray head when the plunger is in first position.

14. The container cleaner of claim 8 further comprising a slot in the exterior wall of the body configured to receive an o-ring therein.

15. The container cleaner of claim 1, wherein the spray head does not include a biasing member that exerts pressure on the base portion.

16. The container cleaner of claim 1, wherein at least a portion of the plunger is configured to extend from spray head in the first position.

17. The container cleaner of claim 16, wherein the plunger is further configured to displace the base portion in response to at least the portion of the plunger receiving pressure.

18. A container cleaner comprising:

a body comprising a fluid passage formed therethrough; and a nozzle assembly comprising:

a spray head engagedly connected to the body and in fluid communication with the fluid passage, the spray head comprising:

a first opening proximal to the fluid passage and a second opening distal to the fluid passage;

a cavity disposed between the first opening and the second opening;

a plunger at least partially disposed through the cavity;

a base portion extending from the plunger; and a stopper disposed between the cavity and the fluid passage, the stopper comprising an aperture configured to receive a portion of the plunger;

wherein, in response to fluid pressure, the base portion forms a seal with the stopper without a spring biasing the base portion; and wherein the plunger operatively brakes the seal between the base portion and the stopper in response to receiving mechanical pressure that is greater than the fluid pressure received by the base portion.

19. The container cleaner of claim 18, wherein at least a portion of the plunger extends from the second opening when the base portion forms a seal with the stopper.

20. The container cleaner of claim 19, wherein at least the portion of the plunger is translatable about an axis of the container cleaner and wherein translation of the plunger breaks the seal.

* * * * *